US005180966A

United States Patent [19]

Sugawara et al.

[11] Patent Number: 5,180,966

[45] Date of Patent: Jan. 19, 1993

[54] CURRENT MIRROR TYPE CONSTANT CURRENT SOURCE CIRCUIT HAVING LESS DEPENDENCE UPON SUPPLIED VOLTAGE

[75] Inventors: Michinori Sugawara; Hiroyuki Takahashi, both of Tokyo, Japan

[73] Assignee: NEC Corporation, Tokyo, Japan

[21] Appl. No.: 748,994

[22] Filed: Aug. 22, 1991

[30] Foreign Application Priority Data

Aug. 22, 1990 [JP] Japan ..... 2-220204

[51] Int. Cl.[5] ..... G05F 5/08; G05F 3/26

[52] U.S. Cl. ..... 323/308; 323/315; 323/316

[58] Field of Search ..... 323/299, 303, 315, 316

[56] References Cited

U.S. PATENT DOCUMENTS

| | | | |
|---|---|---|---|
| 4,327,321 | 4/1982 | Susuki et al. | 323/315 |
| 4,499,416 | 2/1985 | Koike | 323/303 |
| 4,536,702 | 8/1985 | Nagano | 323/316 |
| 4,727,309 | 2/1988 | Vajdic et al. | 323/315 |
| 4,943,737 | 7/1990 | Guo et al. | 307/296.7 |

FOREIGN PATENT DOCUMENTS 310743 4/1989 European Pat. Off. .

*Primary Examiner*—William H. Beha, Jr.
*Attorney, Agent, or Firm*—Sughrue, Mion, Zinn, Macpeak & Seas

[57] ABSTRACT

A current mirror constant current source circuit includes a first current mirror circuit constituted by first and second source-grounded n-channel MOS transistors connected to form a current mirror. A source-drain path of the first MOS transistor forms an input current path of the current mirror circuit, and a source-drain path of the second MOS transistor forms an output current path of the current mirror circuit. A current source is connected between a drain of the first MOS transistor and a high voltage supply line. A third n-channel MOS transistor is connected to have a source and a drain connected to a source and a drain of the first MOS transistor, respectively. A gate of the third MOS transistor is connected to the high voltage supply line. The current source includes a second current mirror circuit formed by two MOS transistors such that the source-drain path of one of the two transistors forms an output current path of the second current mirror circuit. The overall arrangement effectively minimizes the increase of the output current caused by the increase of the voltage supply.

5 Claims, 5 Drawing Sheets

CURRENT MIRROR TYPE CONSTANT CURRENT SOURCE CIRCUIT HAVING LESS DEPENDENCE UPON SUPPLIED VOLTAGE

BACKGROUND OF THE INVENTION

1. Field of the Invention

The present invention relates to a semiconductor integrated circuit, and more specifically to a current mirror type constant current source circuit which is mainly composed of MOS field effect transistors and which can be incorporated in a semiconductor integrated circuit.

2. Description of Related Art

A typical conventional current mirror type constant current source circuit includes a current mirror circuit, which is composed of a first n-channel MOS transistor having a gate and a drain short-circuited to each other, and a second n-channel MOS transistor having a gate connected to the gate of the first n-channel MOS transistor. The drain of the first n-channel MOS transistor is connected through a constant current source to a high level line of a voltage supply, and a source of the first n-channel MOS transistor is connected to a grounded line of the voltage supply. A source of the drain of the second n-channel MOS transistor is also grounded, and a drain of the second n-channel MOS transistor is connected to a load circuit so as to supply a constant current to the load circuit.

With the above mentioned arrangement, a current supplied from the constant current source flows through the first n-channel MOS transistor, and, a corresponding gate-source voltage appears between the gate and the source of the first n-channel MOS transistor. This gate-source voltage of the first n-channel MOS transistor is determined in accordance with the characteristics of the first n-channel MOS transistor, by the current supplied from the constant current source. The gate-source voltage of the first n-channel MOS transistor is applied between the gate and the source of the second n-channel MOS transistor, so that the second n-channel MOS transistor will allow to flow therethrough an output current, which is determined by the applied gate-source voltage in accordance with the characteristics of the second n-channel MOS transistor.

The above mentioned conventional current mirror type constant current source circuit has been disadvantageous in that when a voltage of the voltage supply increases, a current of the second n-channel MOS transistor supplied to the load circuit correspondingly increases, resulting in an increased consumption power.

A source-drain current of a MOS transistor has a positive dependence upon not only a gate voltage but also a source-drain voltage in a saturated region of the characteristics of the MOS transistor. In other words, even if the gate voltage is maintained at a constant level, if the source-drain voltage increases, the source-drain current correspondingly increases. In the above mentioned conventional current mirror type constant current source circuit, the first n-channel MOS transistor and the constant current source form a voltage division circuit between the high level line and the ground line of the voltage supply. Therefore, if the voltage of the voltage supply increases, the source-drain voltage of the first n-channel MOS transistor in the current mirror circuit correspondingly increases, and therefore, the source-drain current of the second n-channel MOS transistor in the current mirror circuit similarly increases.

Particularly, if the constant current source is formed of a p-channel MOS transistor, when the voltage of the voltage supply increases, a change amount of the source-drain voltage of the first n-channel MOS transistor and a change amount of the source-drain voltage of the p-channel MOS transistor are substantially equal to a change amount of the voltage supply. Therefore, with increase of the voltage of the voltage supply, a current of the p-channel MOS transistor and hence the current of the first n-channel MOS transistor are correspondingly increased. As a result, the output current of the second n-channel MOS transistor is increased by the amount in proportion to the amount increased of the current of the first n-channel MOS transistor, and also by the amount dependent upon an increase of the source-drain voltage of the second n-channel MOS transistor itself.

SUMMARY OF THE INVENTION

Accordingly, it is an object of the present invention to provide a current mirror type constant current source circuit which has overcome the above mentioned defect of the conventional one.

Another object of the present invention is to provide a current mirror type constant current source circuit which can be incorporated in a semiconductor integrated circuit, and which can effectively restrain or minimize the increase of the output current caused by the increase of the voltage supply.

The above and other objects of the present invention are achieved in accordance with the present invention by a current mirror type constant current source circuit comprising a current mirror circuit composed of first and second MOS transistors of a first conduction type connected to form a current mirror, a source-drain path of the first MOS transistor forming an input current path of the current mirror circuit, and a source-drain path of the second MOS transistor forming an output current path of the current mirror circuit, a current source connected between an input end of the input current path of the current mirror circuit and a voltage supply line, and a third MOS transistor of the first conduction type having a source and a drain connected to a source and a drain of the first MOS transistor, respectively, a gate of the third MOS transistor being connected to the voltage supply line.

The above and other objects, features and advantages of the present invention will be apparent from the following description of preferred embodiments of the invention with reference to the accompanying drawings.

DESCRIPTION OF THE PREFERRED EMBODIMENTS

Figure 1:
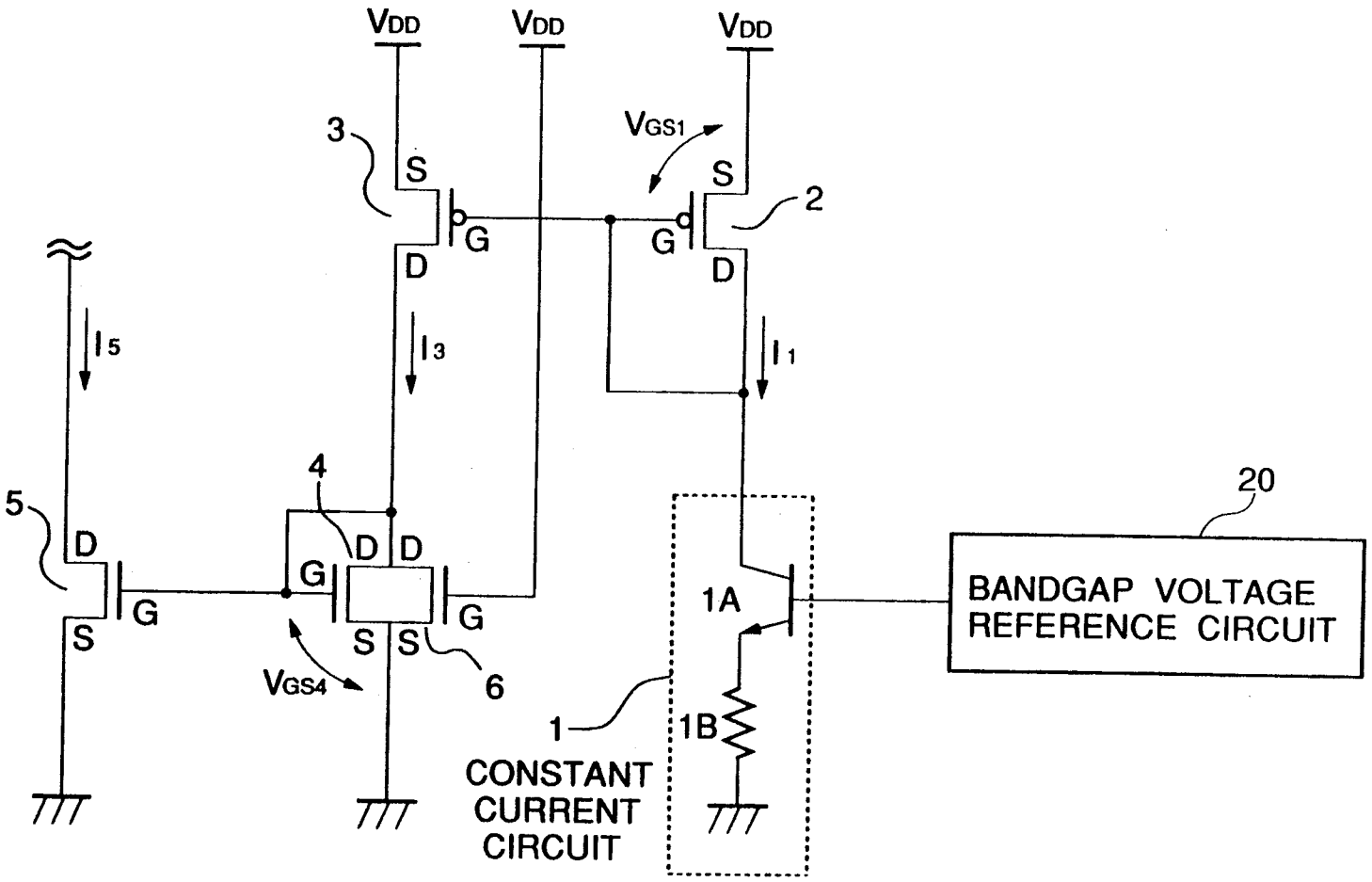
FIG. 1 is a circuit diagram of a first embodiment of the current mirror type constant current source circuit in accordance with the present invention.

Referring to FIG. 1, there is shown a circuit diagram of a first embodiment of the current mirror type constant current source circuit in accordance with the present invention.

The shown current mirror type constant current source circuit includes a bandgap voltage reference circuit 20, which is composed of NPN bipolar transistors (not shown) and operates to supply a reference voltage to a base of an NPN bipolar transistor 1A having an emitter connected through a resistor 1B to ground. The bipolar transistor 1A and the resistor 1B form a constant current circuit 1.

A collector of the transistor 1A, forming an output of the constant current circuit 1, is connected in common to a gate and a drain of a p-channel MOS transistor 2, and a gate of another p-channel MOS transistor 3. A source of each of the p-channel MOS transistors 2 and 3 is connected to a voltage supply voltage $V_{DD}$. The p-channel MOS transistors 2 and 3 form a first current mirror circuit.

A drain of the p-channel MOS transistor 3 is connected in common to a gate and a drain of an n-channel MOS transistor 4, and a gate of another n-channel MOS transistor 5. A source of each of the n-channel MOS transistors 4 and 5 is connected to ground. A source-drain path of the n-channel MOS transistor 5 forms a constant current source, and a drain of the n-channel MOS transistor 5 is connected to a load (not shown).

In addition, another n-channel MOS transistor 6 is connected in parallel to the n-channel MOS transistor 4, in such a manner that a drain and a source of the n-channel MOS transistor 6 are connected to the drain and the source of the n-channel MOS transistor 4, respectively. A gate of the n-channel MOS transistor 6 is connected to the voltage supply voltage $V_{DD}$.

Now, operation of the above mentioned constant current source curcuit will be described.

On the basis of a base bias of the bipolar transistor 1A given from the bandgap voltage reference circuit 20, the constant current circuit 1 and hence the bipolar transistor 1A will generate a collector current $I_1$, which also flows through the p-channel MOS transistor 2. At this time, a gate-source voltage $V_{GS1}$ appears between the gate and the source of the p-channel MOS transistor 2. The gate-source voltage $V_{GS1}$ is determined by the current $I_1$ in accordance with the characteristics of the p-channel MOS transistor 2. As a result, the same gate-source voltage $V_{GS1}$ is applied between the gate and the source of the p-channel MOS transistor 3. Therefore, the p-channel MOS transistor 3 permits to flow a current $I_3$ therethrough, which is determined by the gate-source voltage in accordance with the characteristics of the p-channel MOS transistor 3.

This current $I_3$ flows through the n-channel MOS transistors 4 and 6. Therefore, a gate-source voltage $V_{GS4}$ appears between the gate and the source of the n-channel MOS transistor 4, which gate-source voltage $V_{GS4}$ is determined by the current $I_3$ in accordance with the characteristics of the n-channel MOS transistor 4. This gate-source voltage $V_{GS4}$ is applied between the gate and the source of the n-channel MOS transistor 5. Therefore, the n-channel MOS transistor 5 permits to flow a current $I_5$ therethrough, which is determined by the gate-source voltage in accordance with the characteristics of the n-channel MOS transistor 5. This current $I_5$ is used as a constant current which will be flowed through another circuit (not shown).

Figure 2:
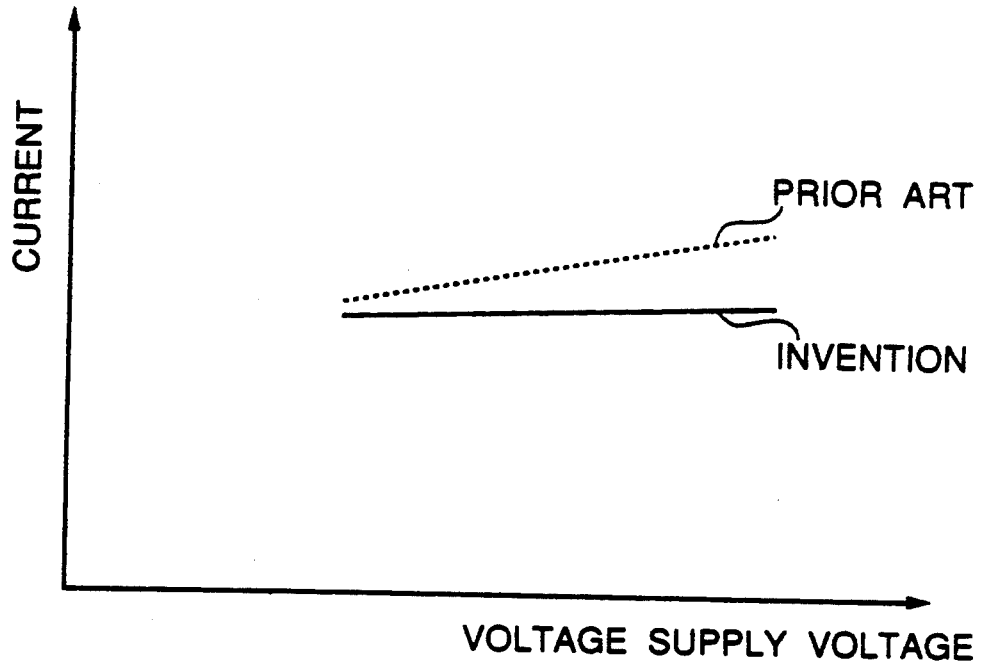
FIG. 2 is a graph illustrating a voltage supply voltage dependence of a current of an input-path n-channel transistor incorporated in the current mirror type constant current source circuit shown in FIG. 1.

Here, referring to FIG. 2, a solid line shows a voltage supply voltage dependence of a source-drain current of the n-channel MOS transistor 4 having the parallel-connected MOS transistor 6, and a dotted line shows a voltage supply voltage dependence of a source-drain current of the n-channel MOS transistor 4 in the case of having no parallel-connected MOS transistor 6.

As seen from FIG. 2, the n-channel MOS transistor 4 having the parallel-connected MOS transistor 6 has a decreased dependence upon the voltage supply voltage. The reason for this is that: When the voltage supply voltage increases, the current $I_3$ of the p-channel MOS transistor 3 also increases, but at this time, since the gate bias of the n-channel MOS transistor 6 is increased by the increased voltage supply voltage, the amount increased of the current $I_3$ of the p-channel MOS transistor 3 is flowed or absorbed by the n-channel MOS transistor 6. Therefore, a change of the gate-source voltage $V_{GS4}$ caused by the increase of the voltage supply voltage is limited to a minimum extent.

Figure 3:
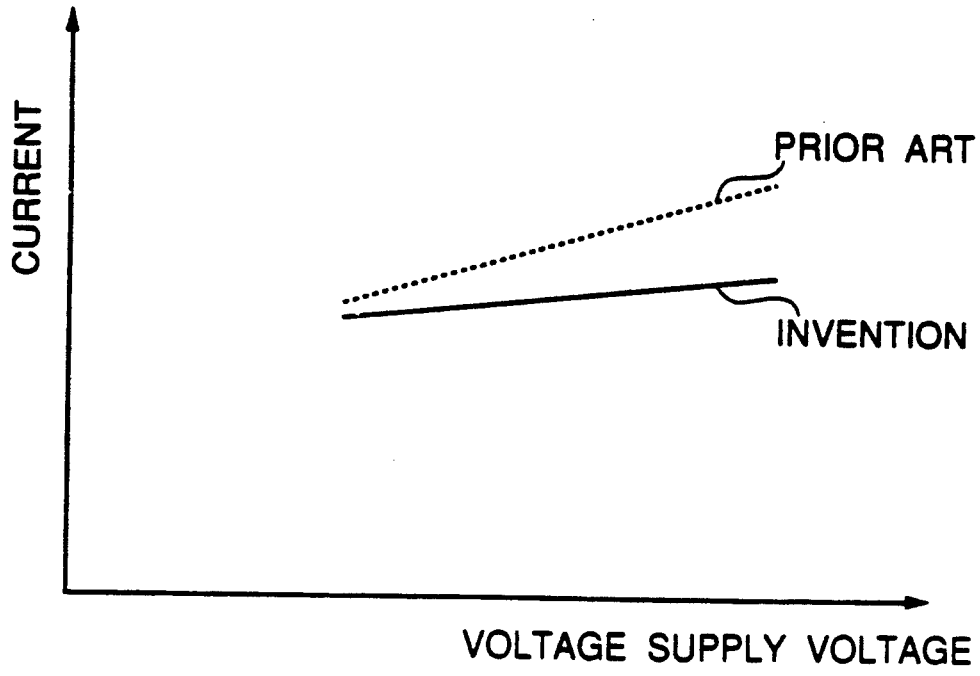
FIG. 3 is a graph illustrating a voltage supply voltage dependence of a current of an output-path n-channel transistor incorporated in the current mirror type constant current source circuit shown in FIG. 1.

As a result, the n-channel MOS transistor 5 has a current-voltage supply voltage characteristics as shown by a solid line in FIG. 3. In FIG. 3, a dotted line shows a voltage supply voltage dependence of a source-drain current of the n-channel MOS transistor 5 in the case of having no n-channel MOS transistor 6. As seen from FIG. 3, it would be understood that the voltage supply voltage dependence of the output current is improved in the embodiment shown in FIG. 1. Therefore, the embodiment shown in FIG. 1 can remarkably restrain or minimize the voltage supply voltage dependence of a constant current source in a semiconductor integrated circuit.

Figure 4:
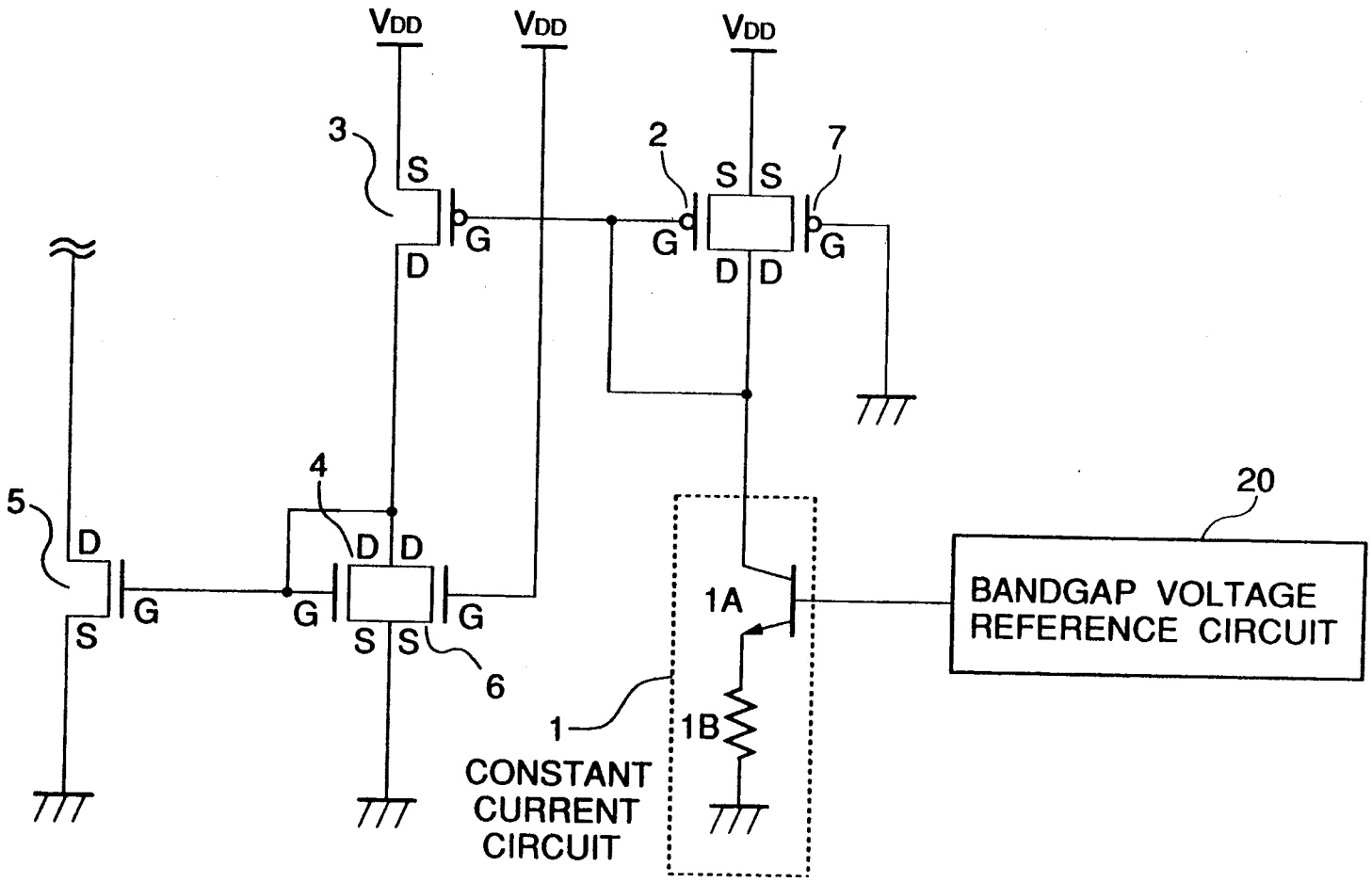
FIGS. 4, 5 and 6 are circuit diagrams of second, third and fourth embodiments of the current mirror type constant current source circuit in accordance with the present invention.

Referring to FIG. 4, there is shown a second embodiment of the current mirror type constant current source circuit in accordance with the present invention. In FIG. 4, elements similar to those shown in FIG. 1 are given the same reference numerals, and explanation thereof will be omitted for simplification of description.

The second embodiment is characterized by addition of a p-channel MOS transistor 7 which has a drain connected to the drain of the p-channel MOS transistor 2, and a source connected to the high voltage $V_{DD}$. A gate of the p-channel MOS transistor 7 is connected to the ground.

With the arrangement of the second embodiment, since a gate-grounded p-channel MOS transistor 7 is connected in parallel to the p-channel MOS transistor 2, the current of the p-channel MOS transistor 2 is decreased with increase of the voltage supply voltage $V_{DD}$. As a result, the voltage supply voltage dependence of the current of the n-channel MOS transistor 5 is furthermore restrained.

Figure 5:
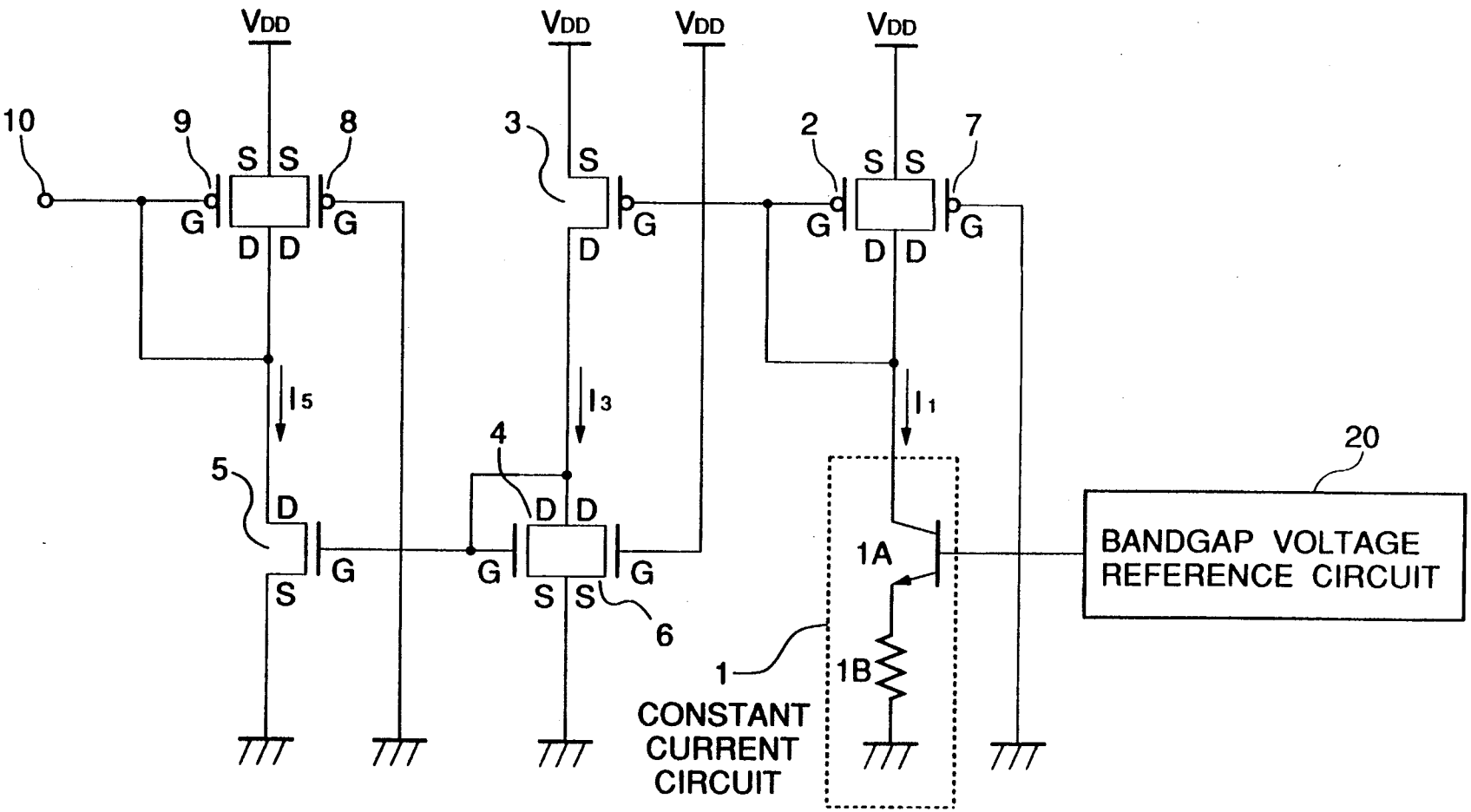

Referring to FIG. 5, there is shown a third embodiment of the current mirror type constant current source circuit in accordance with the present invention. In FIG. 5, elements similar to those shown in FIG. 4 are given the same reference numerals, and explanation thereof will be omitted for simplification of description.

The third embodiment is characterized by addition of a pair of parallel connected p-channel MOS transistors 8 and 9, each of which has a drain connected to the drain of the n-channel transistor 5, and a source connected to the voltage supply voltage $V_{DD}$. A gate of the p-channel MOS transistor 8 is grounded, and a gate of the p-channel MOS transistor 9 is connected to the drain of the p-channel MOS transistor 9 itself, and also connected an output voltage terminal 10.

In the third embodiment, a current-voltage supply voltage characteristics of the p-channel MOS transistor 9 is adjusted by the p-channel MOS transistor 8, so that a high level reference voltage having less dependence upon the voltage supply voltage can be obtained from the output terminal 10 connected to the gate of the p-channel MOS transistor 9.

Figure 6:
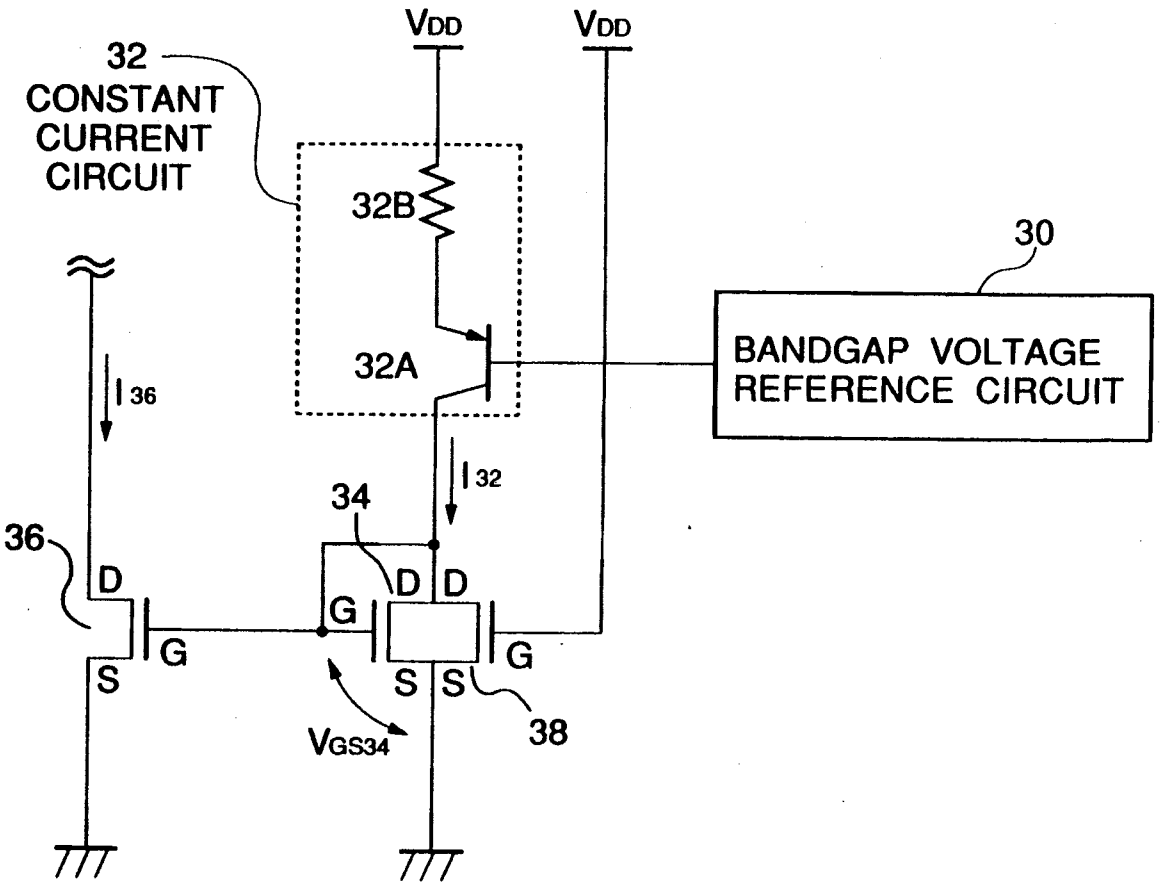

Referring to FIG. 6, there is shown a fourth embodiment of the current mirror type constant current source circuit in accordance with the present invention.

The shown fourth embodiment of the current mirror type constant current source circuit includes a bandgap voltage reference circuit 30 which includes of PNP bipolar transistors (not shown) and which supplies a reference voltage to a base of a PNP bipolar transistor 32A, which has an emitter connected through a resistor 32B to a high voltage $V_{DD}$. The bipolar transistor 32A and the resistor 32B form a constant current circuit 32.

A collector of the transistor 32A, forming an output of the constant current circuit 32, is connected in common to a gate and a drain of an n-channel MOS transistor 34, and a gate of another p-channel MOS transistor 36. A source of each of the n-channel MOS transistors 34 and 36 is connected to the ground. The n-channel MOS transistors 34 and 36 form a current mirror circuit.

In addition, still another n-channel MOS transistor 38 is connected in parallel to the n-channel MOS transistor 34, in such a manner that a drain and a source of the n-channel MOS transistor 38 are connected to the drain and the source of the n-channel MOS transistor 34, respectively. A gate of the n-channel MOS transistor 38 is connected to the voltage supply voltage $V_{DD}$.

Now, operation of the above mentioned fourth embodiment of the constant current source circuit will be described.

On the basis of a base bias of the bipolar transistor 32A given from the bandgap voltage reference circuit 30, the constant current circuit 32 and hence the bipolar transistor 32A will generate a collector current $I_{32}$, which flows through the n-channel MOS transistors 34 and 38. At this time, a gate-source voltage $V_{GS34}$ appears between the gate and the source of the n-channel MOS transistor 34. The gate-source voltage $V_{GS34}$ is determined by the current $I_{32}$ in accordance with the characteristics of the n-channel MOS transistor 34. As a result, the same gate-source voltage $V_{GS34}$ is applied between the gate and the source of the n-channel MOS transistor 36. Therefore, the n-channel MOS transistor 36 permits to flow a current $I_{36}$ therethrough, which is determined by the gate-source voltage in accordance with the characteristics of the n-channel MOS transistor 36.

In the above mentioned operation, the current $I_{32}$ flowing through the PNP transistor 32A is partially shunted or bypassed to the n-channel MOS transistor 38. This n-channel MOS transistor 38 operates similarly to the n-channel MOS transistor 6 of the first embodiment when the voltage supply voltage increases. Therefore, the voltage supply voltage dependence of the current of the n-channel MOS transistor 36 can be restrained or minimized.

As seen from the above, the present invention is characterized by connecting in parallel to a current path MOS transistor, an additional MOS transistor of the same channel type having a gate connected to a voltage supply voltage. With this feature, the current-voltage supply voltage characteristics of the current path MOS transistor is modified so that the amount increased of the current of the current path MOS transistor when a voltage supply voltage increases can be remarkably reduced in comparison with the case in which no addition MOS transistor is connected in parallel to the current path MOS transistor. If the current path MOS transistor having the parallel-connected additional MOS transistor connected is used as an input current path MOS transistor of a current mirror type constant current source circuit, the constant current source circuit having less dependence upon the voltage supply voltage can be obtained.

The invention has thus been shown and described with reference to the specific embodiments. However, it should be noted that the present invention is in no way limited to the details of the illustrated structures but changes and modifications may be made within the scope of the appended claims.

We claim:

1. A current mirror type constant current source circuit comprising:

a current mirror circuit composed of first and second MOS transistors of a first conduction type connected to form a first current mirror, a source-drain path of said first MOS transistor forming an input current path of said current mirror circuit, and a source-drain path of said second MOS transistor forming an output current path of said current mirror circuit, a current source connected between an input end of said input current path of said current mirror circuit and a voltage supply line, and a third MOS transistor of said first conduction type having a source and a drain connected to a source and a drain of said first MOS transistor, respectively, a gate of said third MOS transistor being connected to said voltage supply line, and wherein said current source includes a second current mirror circuit having fourth and fifth MOS transistors which are of a second conduction type opposite to said first conduction type connected to form a second current mirror, a source-drain path of said fourth MOS transistor forming an output current path of said second current mirror circuit and being connected between said input end of said input current path of said first current mirror circuit and said voltage supply line, and a gate of said fourth MOS transistor being connected to a gate of said fifth MOS transistor, a source-drain path of said fifth MOS transistor forming an input current path of said second current mirror circuit and being connected through a second current source between said high voltage supply line and said ground.

2. A current mirror type constant current source circuit claimed in claim 1 wherein said second current source includes a bipolar transistor having a collector connected to one end of said input current path of said second current mirror circuit and a base connected to receive a reference voltage, and an emitter of said bipolar transistor is connected through a resistor to said ground.

3. A current mirror type constant current source circuit claimed in claim 2 wherein said first, second and third MOS transistors are of an n-channel type, said fourth and fifth MOS transistors are of a p-channel type, and said bipolar transistor is of an NPN type.

4. A current mirror type constant current source circuit claimed in claim 1 wherein said first, second and third MOS transistors are of an n-channel type and said fourth and fifth MOS transistors are of a p-channel type.

5. A current mirror type constant current source circuit claimed in claim 4 further including a sixth MOS transistor of a p-channel type having a drain and a source connected a drain and a source of said fifth MOS transistor, a gate of sixth MOS transistor being grounded.

* * * * *